United States Patent [19]

White

[11] 3,989,479

[45] Nov. 2, 1976

[54] GASEOUS FUEL MIXTURE

[75] Inventor: Samuel H. White, Fort Lauderdale, Fla.

[73] Assignee: Anne Joffre White, Fort Lauderdale, Fla.

[22] Filed: Sept. 25, 1973

[21] Appl. No.: 400,689

[52] U.S. Cl. ..... 48/197 FM; 44/52; 44/53; 148/9 R; 252/372

[51] Int. Cl.[2] ..... C10L 3/00

[58] Field of Search ..... 48/197 FM; 44/52, 53; 148/9; 252/372

[56] References Cited

UNITED STATES PATENTS

| | | | |
|---|---|---|---|
| 2,494,219 | 1/1950 | White | 48/180 |
| 2,951,750 | 9/1960 | White | 48/197 FM |
| 3,591,355 | 7/1971 | Kessler | 48/197 FM |

FOREIGN PATENTS OR APPLICATIONS

| | | | |
|---|---|---|---|
| 813,981 | 5/1959 | United Kingdom | 48/197 FM |
| 569,108 | 5/1945 | United Kingdom | 48/197 FM |

*Primary Examiner*—S. Leon Bashore
*Assistant Examiner*—Peter F. Kratz
*Attorney, Agent, or Firm*—Imirie, Smiley & Linn

[57] ABSTRACT

A gaseous fuel for use in heating, hardening, welding, cutting, and other working of metals comprises a mixture of about 80 to 82 per cent propane, or a propane-butane mixture, about 15 to 17 per cent propylene oxide, and about 2 to 4 per cent methanol. The fuel gas is generated from a cylinder containing the foregoing mixture under pressure, by being dispensed through a discharge tube reaching to near the bottom of the cylinder and engaging valve means for dispensing the fuel gas mixture.

1 Claim, No Drawings

GASEOUS FUEL MIXTURE

BACKGROUND OF THE INVENTION

The present invention relates to a gaseous fuel for combustion with oxygen to provide an intense flame temperature for use in the heat working or treatment of ferrous and nonferrous metals, and an effective method for generating and dispensing said gaseous fuel.

Gaseous fuel mixtures have been extensively employed for welding and heating of metals, for example in connection with preheating of metals in cutting operations, in lead burning, case hardening, metal spraying, and the like. Thus, a gaseous fuel consisting of propane, propylene, and a mixture of propylene oxide with diethyl ether is described in U.S. Pat. No. 2,951,750. Another type of fuel gas mixture is disclosed in U.S. Pat. No. 2,411,759, consisting of benzine, diethyl ether, and propane. Fuel gas mixtures of the foregoing types have been conventionally stored in cylinders or other suitable vessels, under pressure, and dispensed through a conventional type of exit valve, which is connected to the particular metal working apparatus being employed.

A disadvantage of the prior art fuel mixtures and dispensing systems has been that, although the individual components have been miscible, they have not been dependably discharged from pressure cylinders or like vessels in the desired proportions, owing to differences in boiling points and volatility characteristics.

SUMMARY OF THE INVENTION

In accordance with a first aspect of the present invention, there is provided a novel fuel gas mixture having a lower ingition temperature, and increased flame intensity and propagation than fuel gas mixtures heretofore known. When burned with oxygen, the novel fuel gas mixture of the invention exhibits improved fuel efficiency, and surpasses in effectiveness the prior art mixtures when applied to the heating and cutting of metals, as well as in other applications, since it does not carburize the surface of edges of the metals, and thus permits easier machining and welding of metal parts. The fuel gas comprises, by weight, propane, or a mixture of propane and butane, with possible traces of propylene, propylene oxide and methanol.

DETAILED DESCRIPTION OF THE INVENTION

According to the invention the fuel gas comprises, by weight, propane, or a mixture of propane and butane, with possible traces of propylene, from about 80% to about 82%, propylene oxide from about 15% to about 17%, and methanol about 2% to 4%. Where a mixture of propane and butane is employed, the proportion of propane may range from about 50% to 99%.

The foregoing mixture is particularly suited for use with oxygen in the working of ferrous and nonferrous metals, for heating, hardening, metal separation, welding, cutting, scarfing, spray of molten metal, lead burning, and numerous other applications.

While the individual components are completely miscible, and they are stored under pressure in cylinders or other vessels, they may be liquefied or gaseous. Since the individual liquid components have different boiling temperature, it is essential that, as dispensed, the critical proportions of the fuel gas mixture be produced and maintained when the mixture is delivered to the flame. Thus, in accordance with a second aspect of the invention, there is provided a method of generating and dispensing the foregoing gaseous fuel mixture from a gas cylinder or other pressure vessel by causing the components, whether in gaseous or liquid state, to pass upward to the point of discharge, through a substantially tubular discharge or dip tube and ejector, of a type commonly employed in the compressed gas handling art, for guiding the mixture under pressure to the discharge point. Such an arrangement is disclosed in U.S. Pat. No. 2,494,219.

The dip or discharge tube extends from a point at the bottom of the cylinder or vessel to the underside of the cylinder valve. The discharge tube is split crosswise for a depth of about ¾″ so that when the tube touches the bottom of the cylinder, the mixture will discharge freely. The upper end of the tube operably engages the cylinder valve with a venturi type mixer through which the fuel gas mixture, in the required proportions, is dispensed to the point of use. In operation, when the cylinder valve is opened, a drop in pressure occurs, forcing the miscible mixture upward through the discharge or pick-up tube to the cylinder valve with which it is connected, and through which the original proportions of the fuel mixture are maintained and dispensed.

The following example, which is to be considered as illustrative, and not as limiting, serves to describe the practice of the invention.

EXAMPLE

There are introduced into a compressed gas cylinder of the requisite size, 80 lbs. of propane, 17 lbs. of propylene oxide, and 3 lbs. of methanol (95% grade). The last two components are liquids. The contents of the cylinder are maintained at the usual pressure sufficient to cause the components to pass through an elongated mixing zone constituted by a discharge or dip tube. The cylinder is fitted with the discharge tube having its lower end split open, a distance of ¾″, and extending to the bottom of the cylinder. The upper end of the tube is connected by a standard venturi to the underside of the cylinder discharge valve. When the valve is opened, the fuel mixture, in vapor form, and in the same proportions as when introduced, is discharged via the cylinder valve, and led through a suitable conduit to the point of use.

The action of the discharge tube appears to be that of providing an elongated mixing zone wherein any liquid components are admixed with the gaseous components, and the mixture is vaporized and discharged.

I claim:

1. A fuel gas consisting essentially of a gaseous mixture of:
   a. from about 80% to about 82% by weight of a member selected from the group consisting of propane, and a mixture of propane and butane containing 50% to 99% propane by weight;
   b. from about 15% to about 17% by weight of propylene oxide vapor; and
   c. from about 2% to about 4% by weight of methanol vapor.

* * * * *